US005820282A

United States Patent [19]

Nakai

[11] Patent Number: 5,820,282

[45] Date of Patent: Oct. 13, 1998

[54] INFORMATION PROCESSING APPARATUS WITH CONVEYANCE PASSAGE DISPLACEMENT MECHANISM

[75] Inventor: Hiroshi Nakai, Yokohama, Japan

[73] Assignee: Canon Kabushiki Kaisha, Tokyo, Japan

[21] Appl. No.: 276,786

[22] Filed: Jul. 18, 1994

[30] Foreign Application Priority Data

Jul. 22, 1993 [JP] Japan ..... 5-181462
Jul. 1, 1994 [JP] Japan ..... 6-150765

[51] Int. Cl.[6] ..... B41J 13/10

[52] U.S. Cl. ..... 400/642; 347/104

[58] Field of Search ..... 400/642, 595, 400/645, 645.4, 645.3, 645.5, 578, 605; 347/104, 101

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,608,577 | 8/1986 | Hori | 346/140 R |
| 4,723,129 | 2/1988 | Endo et al. | 346/1.1 |
| 4,740,796 | 4/1988 | Endo et al. | 346/1.1 |
| 4,843,338 | 6/1989 | Rasmussen et al. | 346/140 R |
| 4,992,805 | 2/1991 | Yoshizawa et al. | 400/642 |
| 5,161,905 | 11/1992 | Eriksson et al. | 400/642 |

FOREIGN PATENT DOCUMENTS

| | | |
|---|---|---|
| 54-56847 | 5/1979 | Japan . |
| 59-123670 | 7/1984 | Japan . |
| 59-138461 | 8/1984 | Japan . |
| 60-71260 | 4/1987 | Japan . |
| 63-165247 | 7/1988 | Japan . |
| 3-295671 | 12/1991 | Japan . |
| 5-124284 | 5/1993 | Japan . |

*Primary Examiner*—Christopher A. Bennett
*Attorney, Agent, or Firm*—Fitzpatrick, Cella, Harper & Scinto

[57] ABSTRACT

The present invention relates to an information processing apparatus having an information processing section for recording information on a sheet member or reading information therefrom. The information processing apparatus further has a platen disposed in the information processing section, a head member disposed opposite to the platen in the information processing section so as to record information on the sheet member or reading information therefrom, a conveyance mechanism for conveying the sheet member while passing it through the information processing section, and a conveyance passage displacement mechanism for displacing a conveyance passage for the sheet member by reciprocating between the platen side of the conveyance passage and the head member side thereof, the moving amount of the conveyance passage displacement mechanism being variable. The present invention thus can provides an information processing apparatus which can maintain a predetermined distance between the sheet member and the head member.

28 Claims, 16 Drawing Sheets

INFORMATION PROCESSING APPARATUS WITH CONVEYANCE PASSAGE DISPLACEMENT MECHANISM

BACKGROUND OF THE INVENTION

1. Field of the Invention

The present invention relates to an information processing apparatus, and particularly to an information processing apparatus in which a sheet member is conveyed at a suitable distance between the sheet member and a head member.

2. Description of the Related Art

In recent years, a note-type personal computer which is convenient for carrying and storage has widely been popularized with miniaturization of personal computers. This is accompanied by increase in the demand for miniaturization of a recording apparatus connected to a personal computer.

In a small recording apparatus, since each of the parts is disposed in a limited space, parts having a low degree of importance are omitted as much as possible, leaving a minimum number of necessary parts alone. For example, a mechanism for conveying paper is constructed in a simple form comprising several rollers, gears and paper guides, and is operated in the state most parts other than the printing portion is outside the device. In such an apparatus, since printing is hardly performed in a large amount at a time, a feed tray and a delivery tray are omitted or provided in an insufficient size from the viewpoint of the space.

A conventional known recording apparatus has the configuration shown in FIG. 1. In FIG. 1, reference numeral 1 denotes a frame body of the recording apparatus, which is divided into two parts, i.e., a first housing 2 and a second housing 3. Both housings 2 and 3 are rotatably connected to each other by a hinge 4. FIG. 1 shows the working state wherein the first housing 2 is raised at 90° with respect to the second housing 3. In the first housing 2 are disposed an ink jet cartridge (IJC) 5 as recording means, and a conveyance roller 9 for conveying recording paper to the cartridge 5. The IJC 5 roughly comprises an ink jet recording head 5*a* and an ink tank 5*b* for supplying necessary ink to the head 5*a*, and is mounted on a carriage 8 which is slidably provided on a pair of parallel rails 7. The parallel rails 7 are disposed in the direction at right angles to a paper conveyance passage which will be described below. The conveyance roller 9 which forms a main passage of the paper conveyance passage is arranged near the IJC 5. In the vicinity of the periphery of the conveyance roller 9, a first pinch roller 10 is arranged near the IJC 5, and a second pinch roller 11 is arranged near the second housing 3 at a distance from the IJC 5. A conveyance guide 12 is arranged between both pinch rollers 10 and 11 along the periphery of the conveyance roller 9 at a predetermined clearance therefrom. In the first housing 2, a feed roller 13 having a diameter smaller than that of the conveyance roller 9 is arranged near the second housing 3. The feed roller 13 contacts a separation pad 14 which is provided on the upper surface of the second housing 3 because both housing 2 and 3 are at right angles, as shown in FIG. 1. The separation pad 14 is provided near the hinge 4 and is urged by an urging member 15 such as a coil spring or a plate spring in the direction to push the separation pad 14 on the feed roller 13. The feed roller 13 and the separation pad 14 form an automatic paper feeder employing frictional separation. The upper surface of the second housing 3 forms a paper feed tray 16 for paper as a recording medium subjected to recording. In recording, the paper on the paper feed tray 16 is sent to the second pinch roller 11 by rotation of the feed roller 13, and then sent on the conveyance roller 9 along the conveyance guide 12 to the first pinch roller 10. The paper passed between the first pinch roller 10 and the conveyance roller 9 is passed on a virtual conveyance plane C defined by a line connecting the tangent of both rollers 9 and 10 and the tangent of a pair of delivery rollers 17 and 18 in contact with each other and passing through a portion near the ink jet recording head 5*a* of the IJC 5. A platen 19 as conveyance plane supporting means is provided at a position opposite to the ink jet recording head 5*a* with the conveyance plane C therebetween. The platen 19 can attain a predetermined clearance between the paper on the conveyance passage and the ink jet recording head 5*a*.

However, when the trailing end of the paper on the conveyance passage is separated from the first pinch roller 10 and the conveyance roller 9, as shown in FIG. 1, since the paper is supported only by the delivery rollers 17 and 18, the front half of the paper falls onto the feed tray 16, and the trailing end rises toward the ink jet recording head 5*a*. Thus, the predetermined clearance (for example, about 1 mm) between the paper and the ink jet recording head 5*a* cannot be maintained. If recording is continued, the contact between the paper and the head 5*a* causes the danger of producing remarkable ink stains or breaking the printing surface of the head 5*a*.

A method of preventing the above problem is a control method in which recording is stopped immediately before the trailing end of the paper is separated between the first pinch roller 10 and the conveyance roller 11, and the paper is then delivered. This method causes the new problem of a large margin at the trailing end of the paper.

In some cases, the paper is slacked on the platen 19 due to the inclination of the front half of the paper even in the state the trailing end thereof is held between the first pinch roller 10 and the conveyance roller 9.

Japanese Patent Laid-Open No. 63-165247 discloses a conveyance apparatus in which a guide plate comprising a curved surface having a center of curvature on the side of a head member (recording head or reading head) is provided on at least one of the upper stream and downstream sides of a platen in the conveyance direction of a sheet member so that the sheet member is kept in a state where it adheres to the platen during conveyance.

However, this apparatus has the problem that since the guide plate is provided on at least a portion before or after the platen to form a sheet member conveyance passage having a predetermined curvature, difficulties are caused in attempting to miniaturize the whole apparatus.

In addition, U.S. Pat. No. 4,843,338 discloses a construction in which the top surface of a driving roller 18 is positioned above the surface of the discharge opening of a print head so that a recording medium is reversely warped and conveyed away from the print head immediately before it enters a print region.

However, in this construction, since the top surface of the driving roller must be positioned above the discharge opening surface of the print head, the size of the recording apparatus is increased. The construction also has the problem that since the reverse warp has a constant radius of curvature, when a recording medium having high rigidity is conveyed, a desired warp cannot be formed in the recording medium in the print region.

SUMMARY OF THE INVENTION

It is an object of the present invention to provide an information processing apparatus which can maintain a predetermined distance between a sheet member and a head member for executing recording of information on the sheet member or reading of information therefrom.

It is another object of the present invention to provide an information processing apparatus which can maintain a predetermined distance between a sheet member and a head member regardless of the rigidity of the sheet member.

It is still another object of the present invention to provided an information processing apparatus which can perform high-quality recording on a sheet member by maintaining a predetermined distance between a sheet member and a head member regardless of the rigidity of the sheet member.

It is a further object of the present invention to provide an information processing apparatus comprising an information processing section for recording information on a sheet member or reading information therefrom, a platen disposed in the information processing section, a supporting member disposed opposite to the platen in the information processing section so as to support a head member for recording information on the sheet member or reading information therefrom, a conveyance mechanism for conveying the sheet member while passing it through the information processing region, and a conveyance passage displacement mechanism for displacing the conveyance passage by reciprocating between the platen side and the supporting member side of the conveyance passage of the sheet member in a variable moving amount.

DETAILED DESCRIPTION OF THE INVENTION

Embodiments of the present invention are described below with reference to the drawings.

Although each of the embodiments relates to a recording apparatus as an information processing apparatus having a print head 5*a* for non-contact recording on paper P as a sheet member, the present invention is not limited to this, and the present invention can suitably be applied to an information processing apparatus comprising a read head for reading the information described on an original as the sheet member. Further, the invention can suitably be applied to an information processing apparatus comprising exchangeable record and read heads for executing recording of information on the sheet member or reading information therefrom.

(Embodiment 1)

Figure 1:
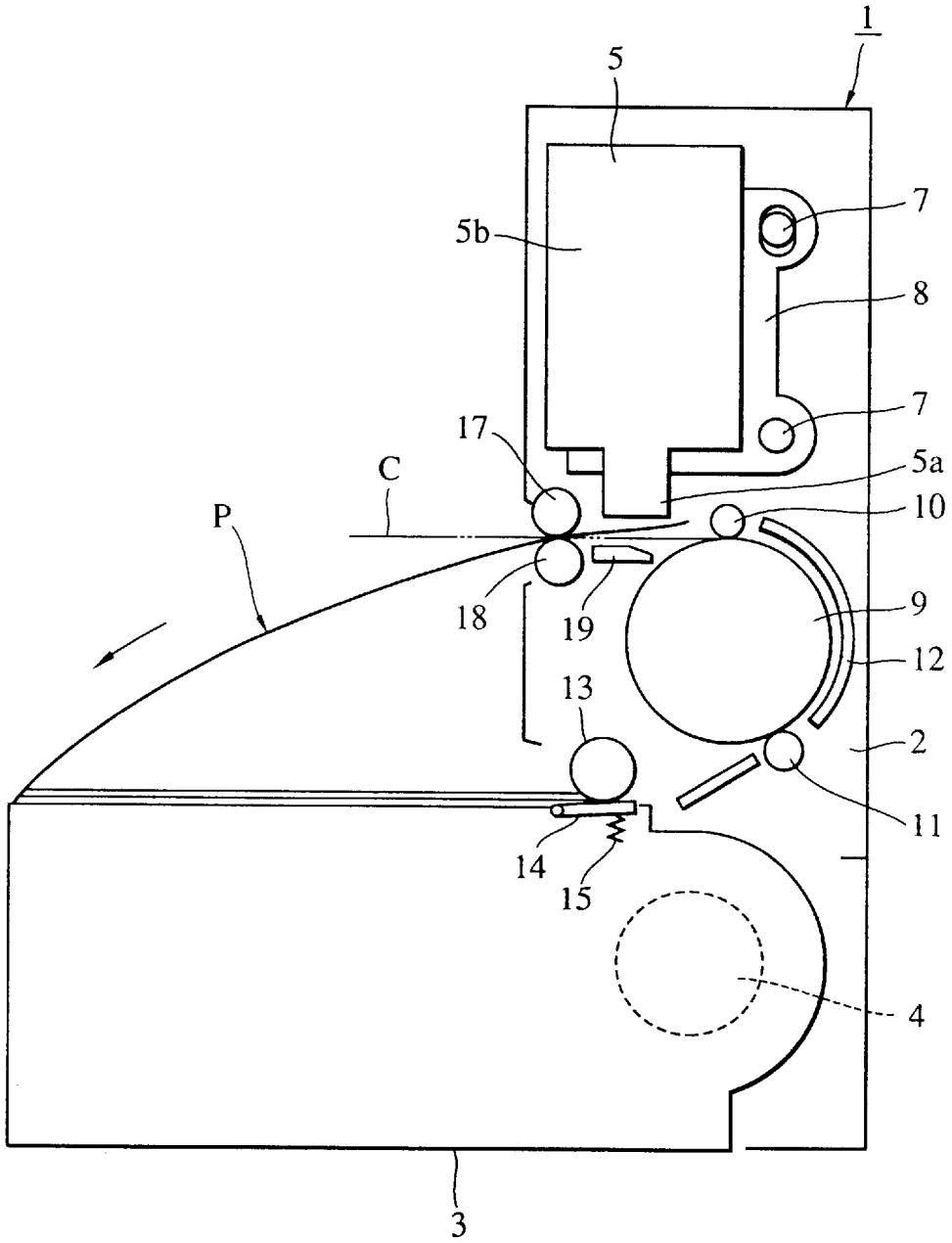
FIG. 1 is a schematic sectional view illustrating the internal structure of a conventional apparatus.
Figure 2:
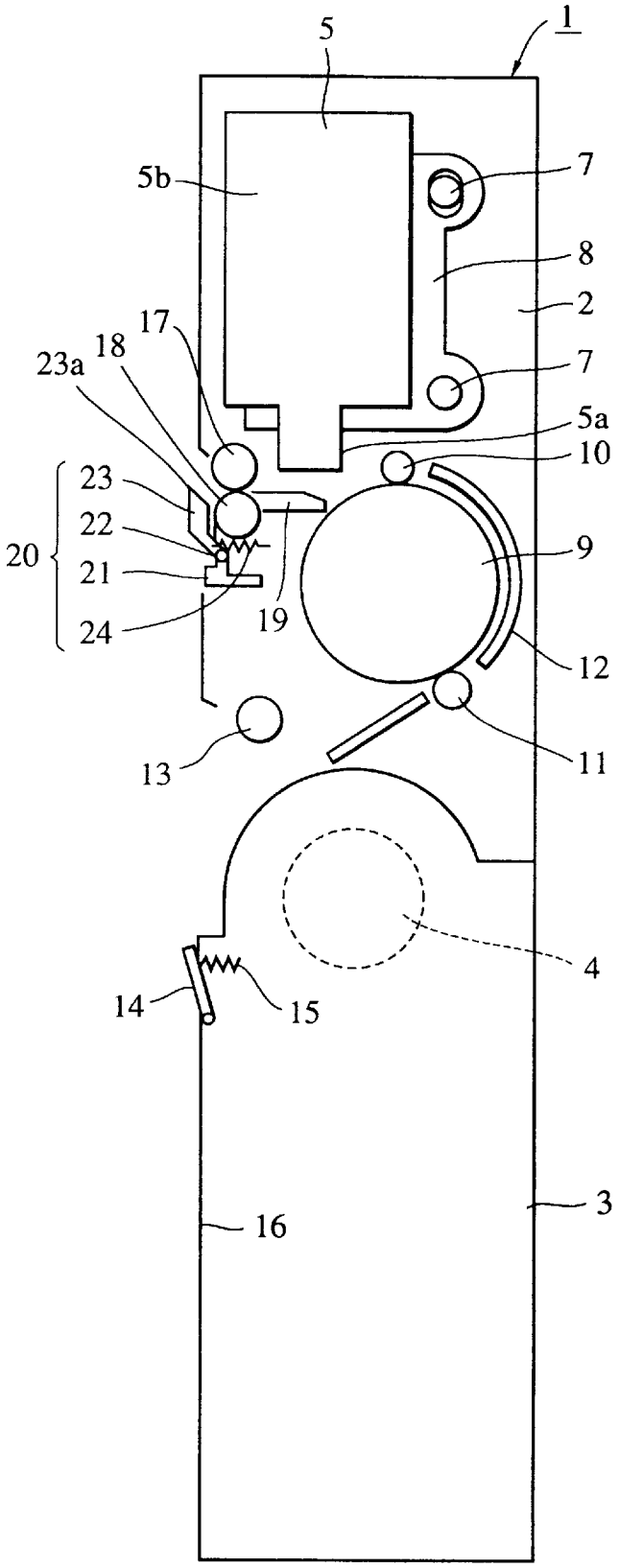
FIG. 2 is a schematic sectional view illustrating an apparatus in accordance with a first embodiment of the present invention.
Figure 3:
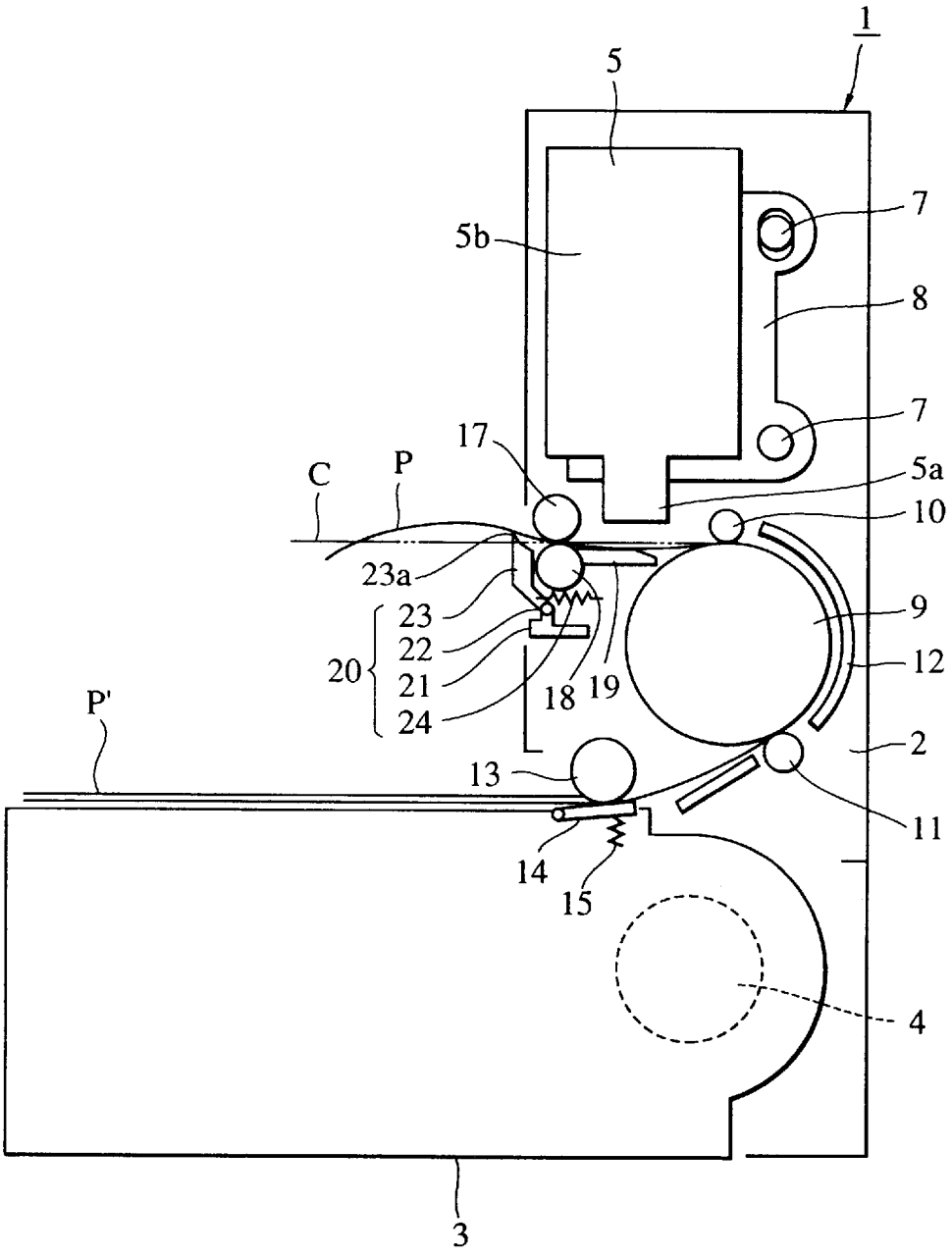
FIG. 3 is a schematic sectional view illustrating the recording state where the apparatus shown in FIG. 2 is bent.

FIGS. 2 and 3 are both schematic sectional views illustrating a first embodiment of the present invention. FIG. 2 illustrates a storage state, and FIG. 3 illustrates a working state. This embodiment is different from the conventional example shown in FIG. 1 in the point that a delivery guide member 20 as delivery guide means is provided on the conveyance passage on the downstream side of the delivery rollers 17 and 18. The delivery guide member 20 comprises a movable member 23 which holds the delivery roller 18 and which is slidably fixed, through a hinge 22, to a portion of a fixed member 21 having a platen 19 integrally formed thereon, and an urging member 24 which has an end fixed to the movable member 23 and the other end fixed to the fixed member 21, and which urges the movable member 23 in the direction to bring it near the delivery roller 18. The tip 23*a* of the movable member 23 is set so as to project to the side of the delivery roller 17 beyond the conveyance plane C.

The recording operation of the recording apparatus configured as described above is described. The housings 2 and 3 are rotated through about 90° to change the storage state shown in FIG. 2 to the working state shown in FIG. 3. At this time, the feed roller 13 on the side of the housing 2 contacts the separation pad 14 on the side of the housing 3 due to the change of the state to form an automatic paper feed device employing frictional separation in the working state. A stack of papers P' is loaded on the upper surface of the housing 3 so as to abut against the contact portion between the feed roller 13 and the separation pad 14, as shown in FIG. 3. When a print signal is transmitted from a host computer (not shown), the feed roller 13 is rotated to feed only the uppermost paper of the loaded stack of papers P' by frictional separation. The fed paper P is passed through the pinch roller 11 along the conveyance guide 12, held by the pinch roller 10 and is then sent to the platen 19. When the leading end reaches a predetermined position, the conveyance roller 9 is stopped, and the recording operation is started. The recording operation is performed for one line in accordance with the recording signal output from the host computer while the carriage 8 provided with the ink jet cartridge 5 is moved along a pair of rails 7. After completion of recording for one line, the conveyance roller 9 is rotated in a predetermined amount to convey the paper to a next recording position, and recording is again performed for one line. A series of the operations are repeated, and when recording is completed over the whole region of the paper, the paper P is delivered to the outside of the apparatus.

When paper such as ordinary paper having relatively low rigidity is conveyed, since the tip 23*a* of the movable member 23 of the delivery guide member 20 is provided so as to project to the side opposite to the platen 19 from the conveyance plane C denoted by a two-dot chain line, as shown in FIG. 3, the conveyance direction of the paper delivered from the delivery rollers 17 and 18 is changed to the side opposite to the platen 19 from the conveyance plane C along the delivery guide member 20, thereby bending the paper between the delivery rollers 17 and 18 and the delivery guide member 20. This bending generates restoring force to return the paper to the original state thereof. The restoring force acts to push the rear half of the paper on the platen 19, thereby preventing floating of the paper and preventing contact with the print head 5*a* during recording. After the trailing end of the paper is separated between the conveyance roller 9 and the pinch roller 10, the paper is also pushed on the side of the platen 19 by the restoring force, thereby preventing rising of the trailing end of the paper. It is thus possible to achieve stable conveyance and good recording, and extend the recordable region.

Figure 4:
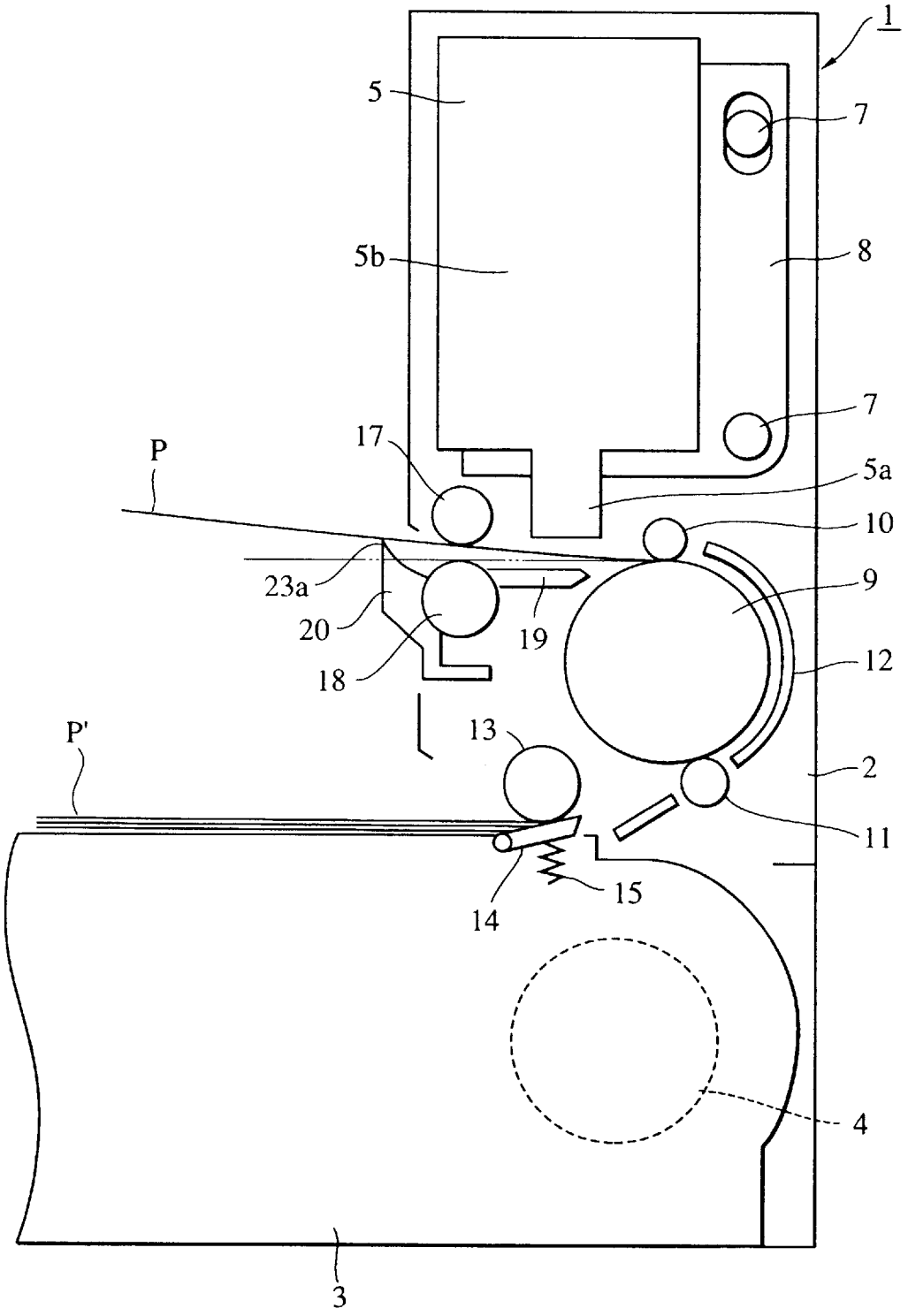
FIG. 4 is a schematic sectional view illustrating the problem which possibly occurs in the apparatus in accordance with the first embodiment of the present invention.

However, when at least two cardboards, postcards or envelopes are piled, if the paper is bent and conveyed by the delivery guide member 20, the delivery guide member 20 produces great resistance due to the high rigidity of the paper, thereby causing the problems of a decrease in the conveyance amount, wrinkling or folding of the paper, and damage of the paper by the delivery guide member 20. Particularly, in an ink jet type recording apparatus, since the recording surface of paper must be pressed by the delivery roller 17 before ink is completely dried, the delivery roller 17 has a blade-like thin disk-formed portion of contact with paper or a spur-formed portion of point contact with paper. In order to protect the contact portion of the delivery roller, the contact pressure on the paper is thus set to as low pressure as possible which allows conveyance of the paper. When paper having high rigidity is conveyed, therefore, the paper is not bent, and the delivery roller 17 is thus floated, as shown in FIG. 4, thereby causing the problem that the conveyance force is not transmitted to the paper.

Figure 5:
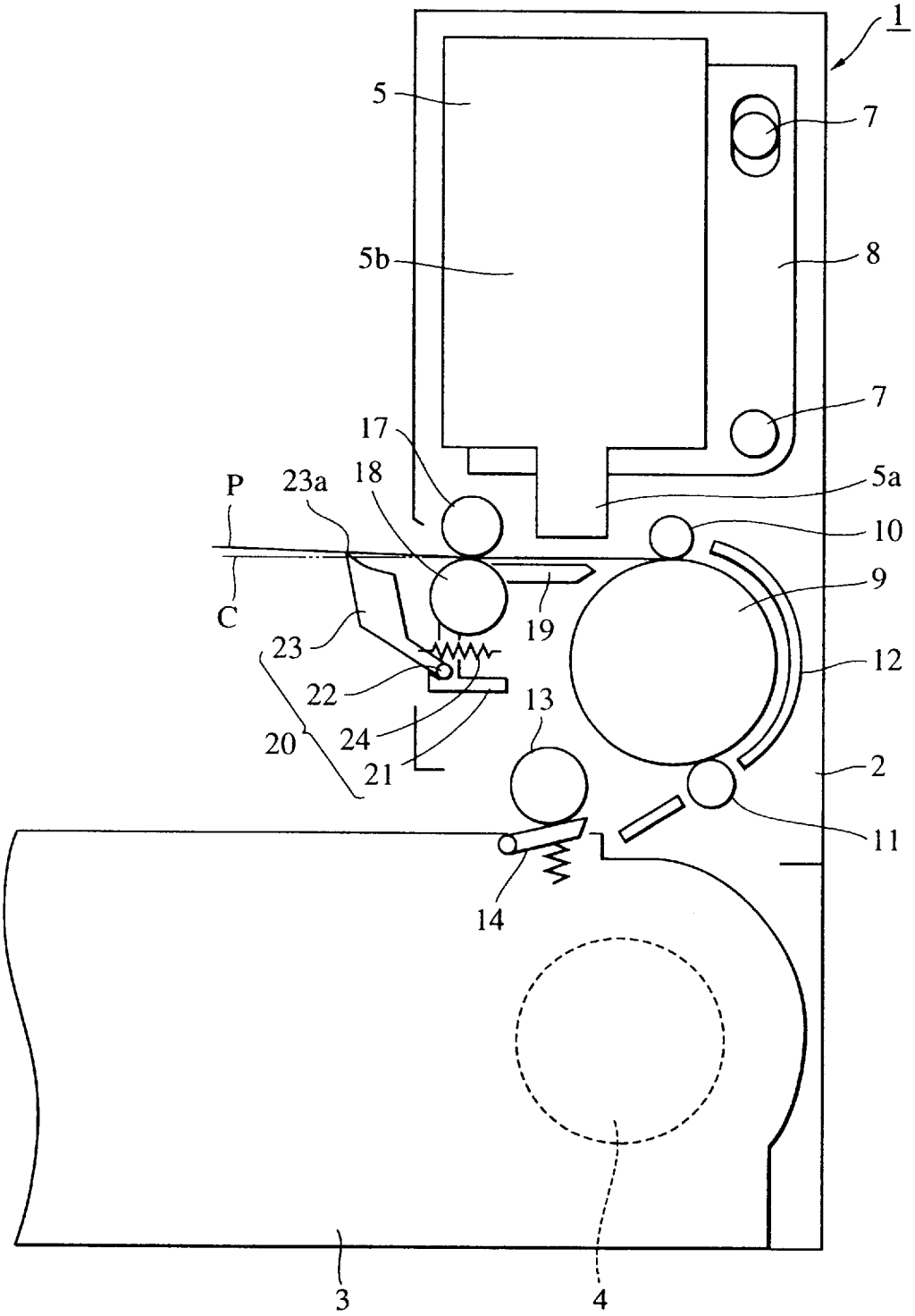
FIG. 5 is an enlarged schematic sectional view illustrating a paper conveyance passage of the apparatus shown in FIGS. 2 and 3.
Figure 6:
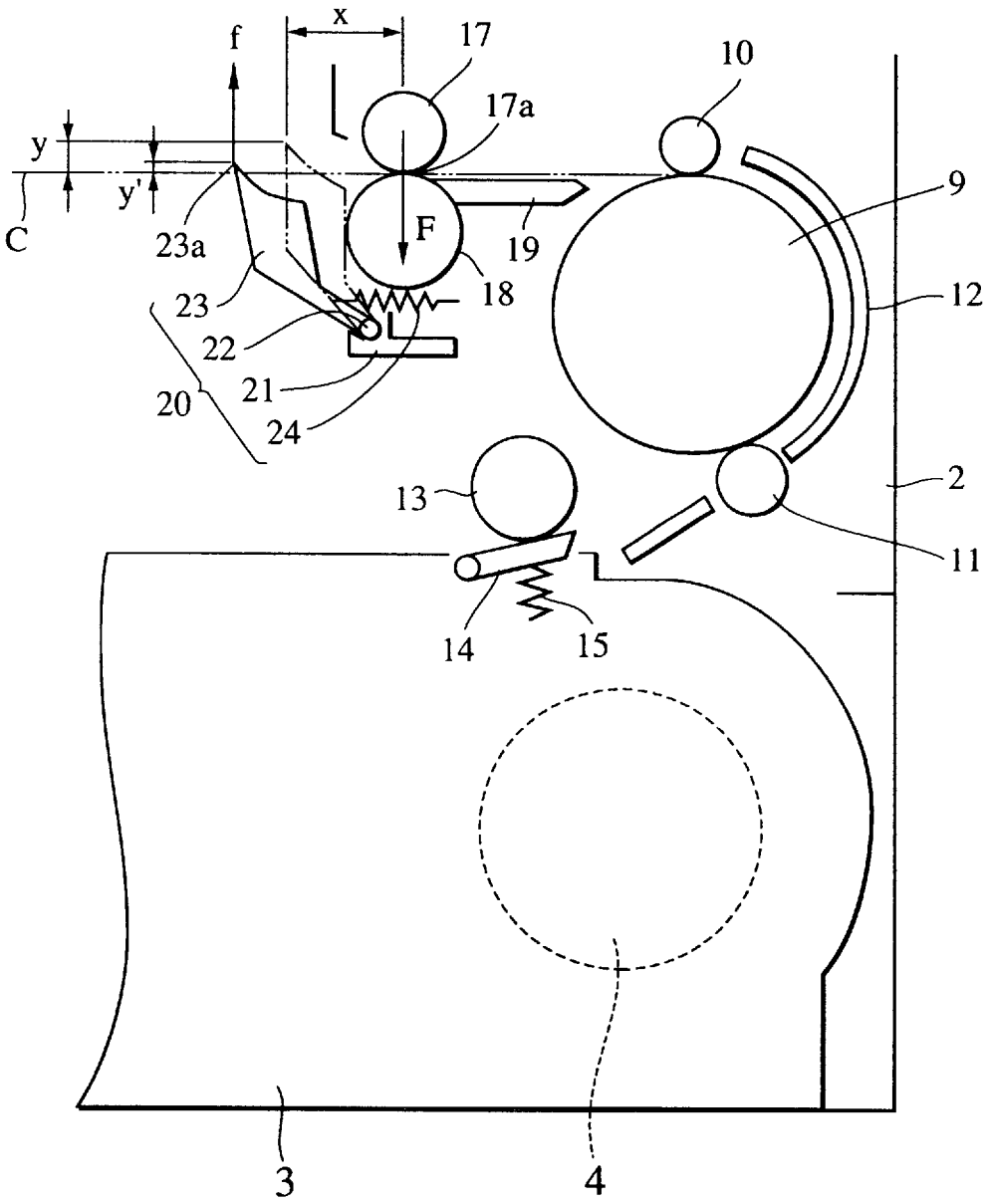
FIG. 6 is a schematic sectional view illustrating conditions for setting delivery guide means relative to a paper conveyance plane in the apparatus shown in FIGS. 2 and 3.

In this embodiment, since the delivery guide member 20 is rotatably mounted and is urged by an elastic member (urging member 24) such as a coil spring or a plate spring, when low-rigidity paper is conveyed, the urging force is appropriately set to bend the paper and generate a degree of restoring force in the paper, and the recording portion of the paper is pressed on the side of the platen 19 to prevent floating of the paper. When high-rigidity paper is conveyed, since the delivery guide member 20 does not bend the paper and is pushed by the paper to be retracted without producing great conveyance resistance, as shown in FIG. 5, the high-rigidity paper can stably be conveyed. The conditions for setting the urging force and the top height of the delivery guide member 20 are as follows:

When the delivery guide member 20 shown in FIG. 6 is at the position of delivery of ordinary paper shown by the two-dot chain line, the height y of the tip 23*a* from the conveyance plane C is determined by the contact pressure F of the delivery roller 17 and the distance x between the tip 23*a* and the contact portion 17*a* between the delivery roller 17 and the paper P on the conveyance plane C. Since the bending of the paper and the conveyance resistance of the delivery guide member 20 increase with increase in the slope y/x within the region from contact portion 17*a* to the tip 23*a*, the height y which allows conveyance of ordinary paper can appropriately be determined by the contact pressure F of the delivery roller 17.

When the delivery guide member 20 is retracted in conveyance of thick paper, the height y' must be set so that the delivery guide member 20 is the same height as the conveyance plane C or slightly projects toward the side opposite the platen 19. This is because the trailing end of the high-rigidity paper can sufficiently be prevented from floating by supporting it at two separate positions in the conveyance direction even if the contact portion 17*a* is at the same height as the tip 23*a*.

The urging force of the delivery guide member 20 must be set so that the the maximum of the contact pressure f between the tip 23*a* of the delivery guide member 20 and the paper P and the contact pressure F of the delivery roller satisfies the relation, $F>f$. This is because, if $F \leqq f$, the delivery roller 17 is floated before the delivery guide member 20 is retracted, thereby causing a failure in conveyance. For paper having various degrees of rigidity, when paper has rigidity lower than that of thick paper for which the delivery guide member 20 is previously set in correspondence with the contact force, the delivery guide member 20 is at a position between the conveyance position of ordinary paper and the retracted position to appropriately bend the paper. Since high-rigidity paper does not fall to a position below the retracted position, it is possible to securely prevent floating of the trailing end of the paper.

(Embodiment 2)

Figure 7:
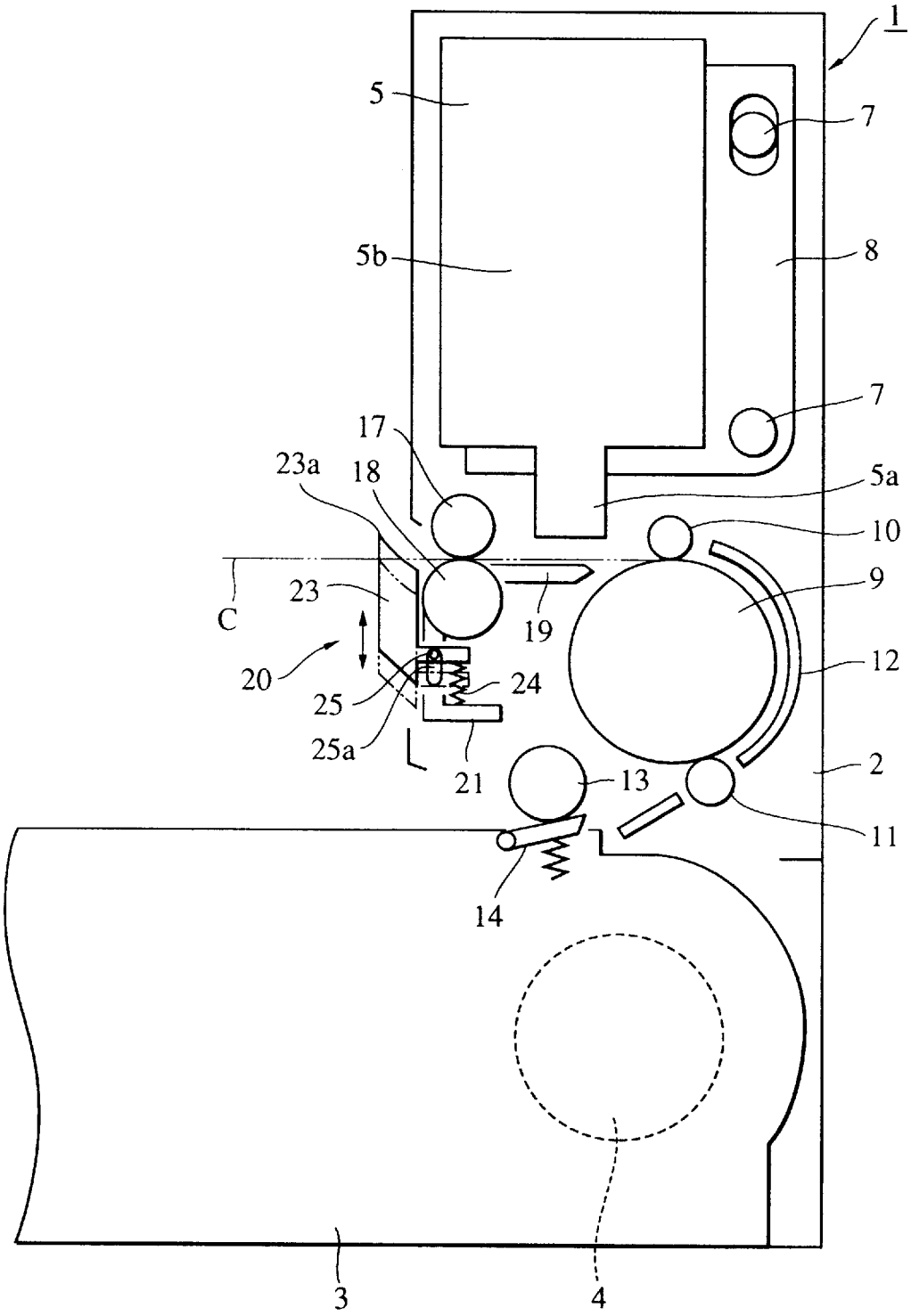
FIG. 7 is a schematic sectional view illustrating an apparatus in accordance with a second embodiment of the present invention.

FIG. 7 illustrates an apparatus in accordance with a second embodiment of the present invention. This embodiment is characterized in that the delivery guide member 20 is mounted so as to be slidable toward the side of the conveyance plane, and that the delivery guide member 20 is urged to the side opposite to the platen 19. In this embodiment, the delivery guide member 20 roughly comprises a fixed member 21 fixed to the first housing 2, an urging member 24 such as a coil spring or the like which is fixed to a part of the fixed member 21, a guide groove 25*a* for guiding a movable member 23 provided on the fixed member 21, a boss 25 engaging the guide groove 25*a* so as to determine the track of the movable member 23, and the movable member 23 provided so as to be slidable in the arrow direction shown in FIG. 7 by the urging force of the urging member 24 and the reaction thereto. The tip 23*a* of the movable member 23 is positioned on the conveyance plane C even when the movable member 23 is retracted, and significantly projects from the paper conveyance plane C when the movable member 23 is forwardly moved. This embodiment thus can obtain the ability to prevent floating of the trailing end of the paper and the stability of paper conveyance, as in the first embodiment.

In this embodiment, the urging force and the height of the delivery guide member 20 can be set in the same manner as in the first embodiment. In addition, since registration can simply and precisely be performed after the delivery guide member 20 is retracted, and the delivery guide member 20 is not projected to the outside of the apparatus, as compared with a rotation type, this embodiment is more suitable for miniaturization of the apparatus.

(Embodiment 3)

Figure 8:
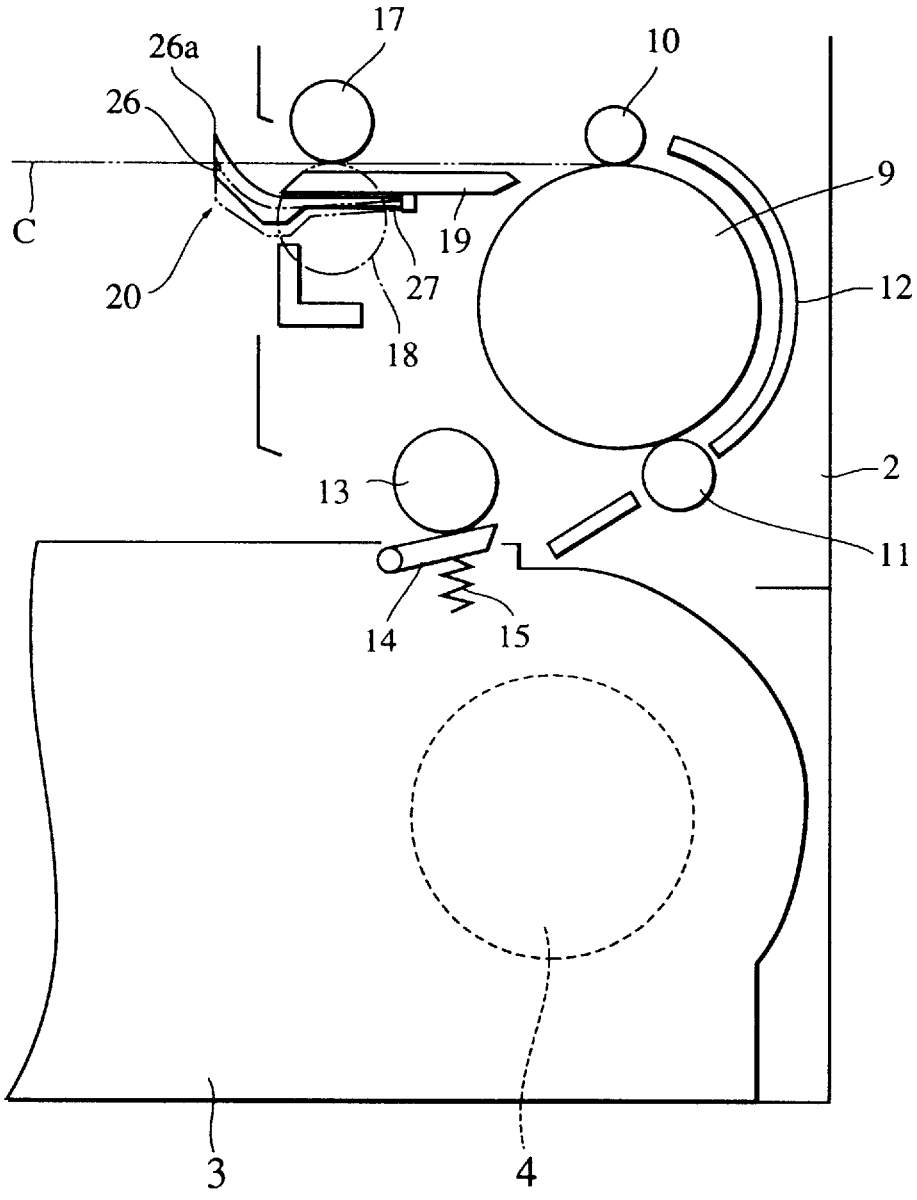
FIG. 8 is a schematic sectional view illustrating an apparatus in accordance with a third embodiment of the present invention.

FIG. 8 is a drawing illustrating an apparatus in accordance with a third embodiment of the present invention. This embodiment is characterized in that an elastic portion is provided on the delivery guide member 20, and that the elastic portion comprises a metallic plate spring or an integrally-molded resin member. The delivery guide member 20 comprises a paper guide portion 26 and an elastic portion 27 which generates urging force. The guide portion 26 is provided with a degree of strength so as not to deform for securely positioning the tip 26*a* thereof. The thickness, length and width of the elastic portion 27 are determined so as to generate the urging force which permits the delivery guide member 20 to give appropriate contact force to the paper. In this embodiment, the elastic portion 27 is fixed to the lower side of the platen 19.

In the above structure, the cost can be decreased by disuse of an elastic member as a separate member, and assembly properties can be improved by formation of the delivery guide member as one unit.

(Embodiment 4)

Figure 9:
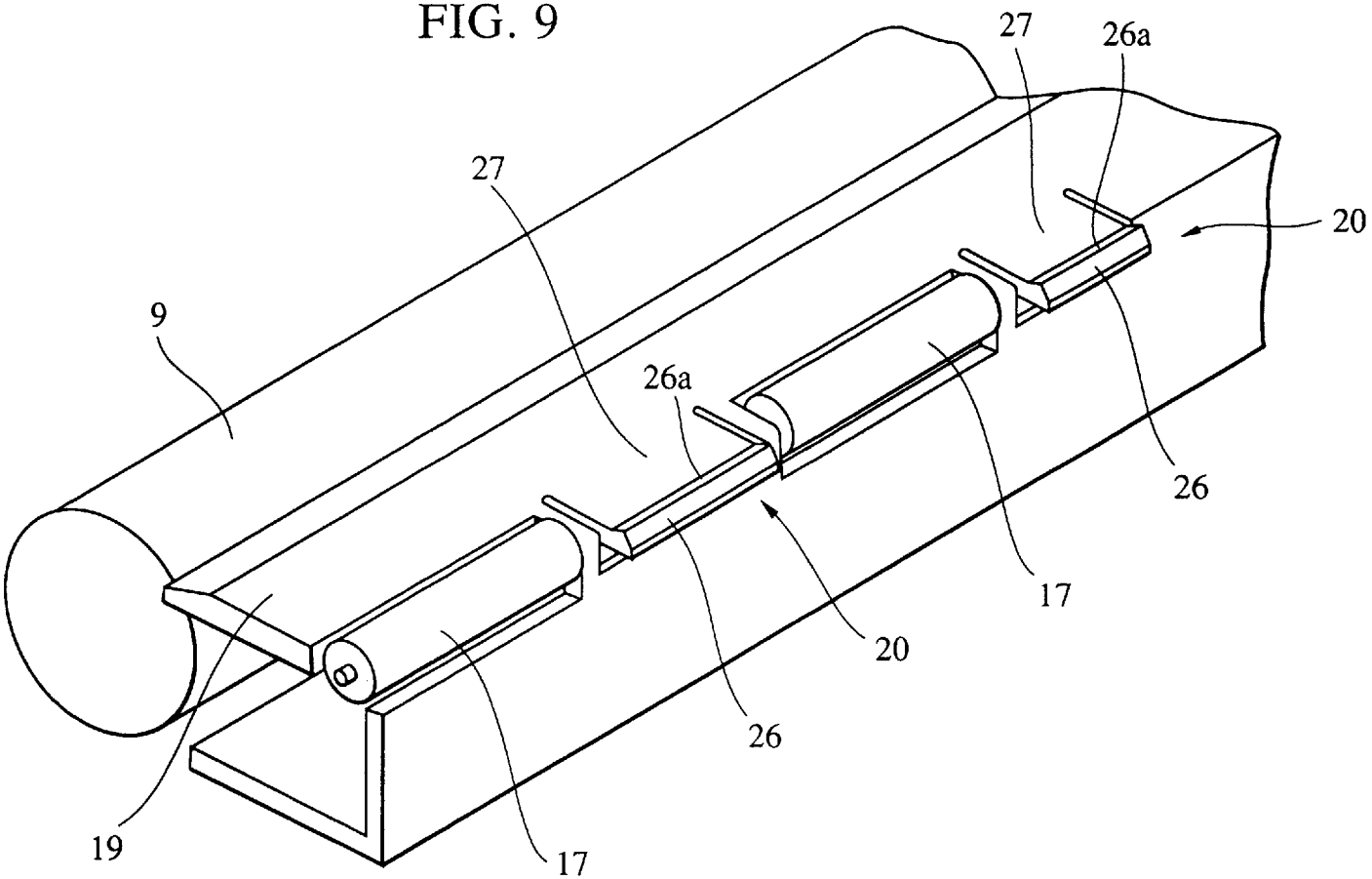
FIG. 9 is a schematic partial perspective view illustrating an apparatus in accordance with a fourth embodiment of the present invention.

FIG. 9 is a drawing illustrating an apparatus in accordance with a fourth embodiment of the present invention. This embodiment is characterized in that the delivery guide member comprises the guide member 26 and the elastic portion 27 both of which are formed integrally with the platen 19.

In this embodiment, the contact force of the delivery guide member 20 is determined by the thickness, length and width of the elastic portion 27, as in the third embodiment. In addition, the tip 26*a* of the guide portion 26 can be precisely positioned due to integral formation, thereby eliminating the need for adjustment by assembly. It is thus possible to further decrease the number of parts and improve the assembly properties.

(Embodiment 5)

Although, in the above embodiment 4, one elastic member is provided on one delivery guide member 20, one elastic member can not always comply with all papers having various degrees of rigidity according to the structure of the apparatus because the change in the urging force of the elastic member by the moving stroke of the delivery guide member 20 is single. In this embodiment, the urging force is stepwisely changed for taking a measure against this problem.

Figure 10:
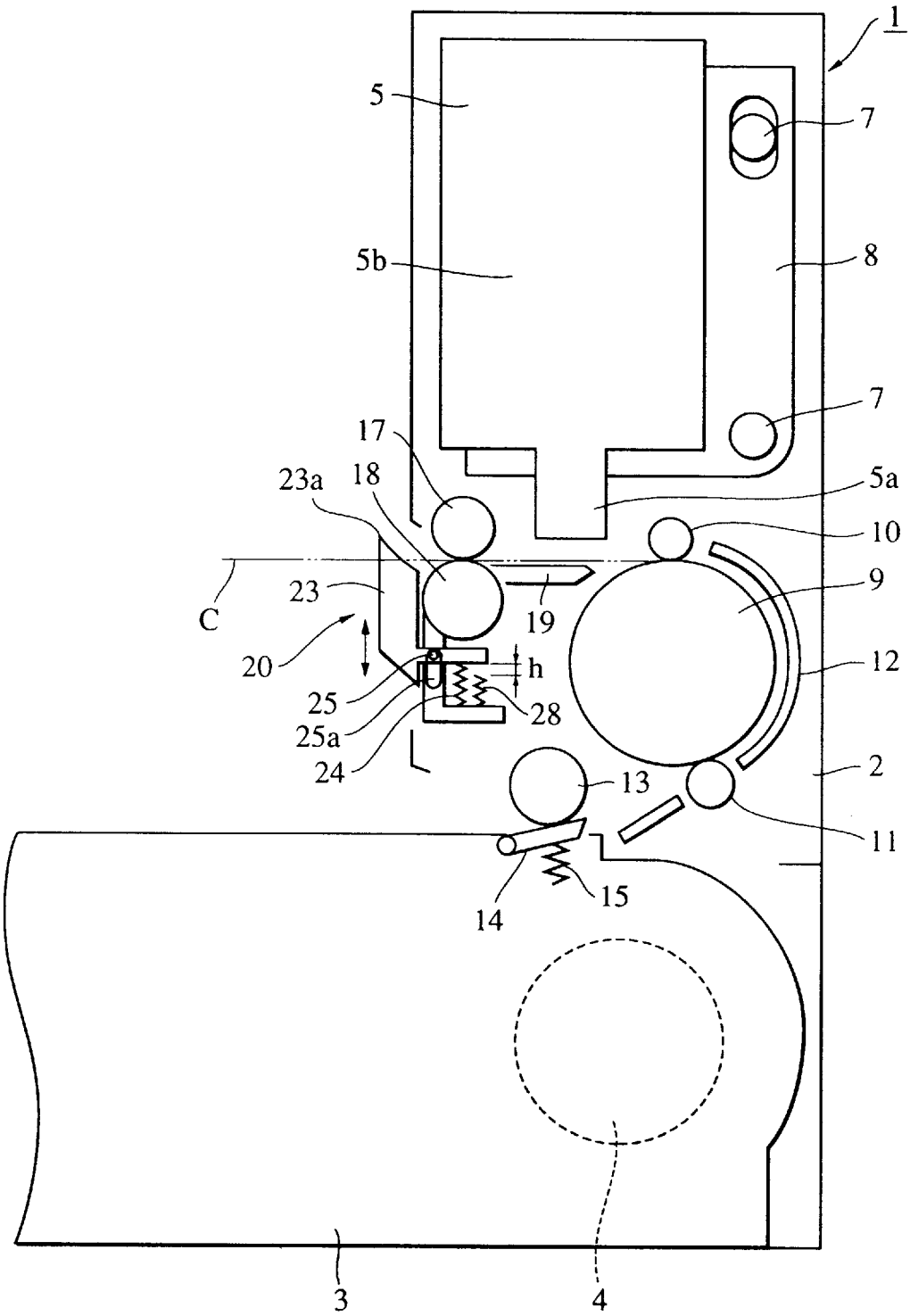
FIG. 10 is a schematic sectional view illustrating an apparatus in accordance with a fifth embodiment of the present invention.

FIG. 10 is a drawing illustrating an apparatus in accordance with a fifth embodiment of the present invention. As illustrated in FIG. 10, a plurality of elastic members 24 and 28 are provided for urging the slide type delivery guide member 20. The urging force of the elastic member 24 alone is used until the delivery guide member 20 falls by a stroke h from the ordinary paper conveyance position, and the delivery guide member 20 contacts the elastic member 28 when falling by an amount larger than the stroke h. At this time, since the spring constant changes, the urging force stepwisely changes. This broadens the set range of the urging force, and is more compatible with an apparatus, as well as achieving suitable urging force for the delivery guide member 20.

(Embodiment 6)

Figure 11:
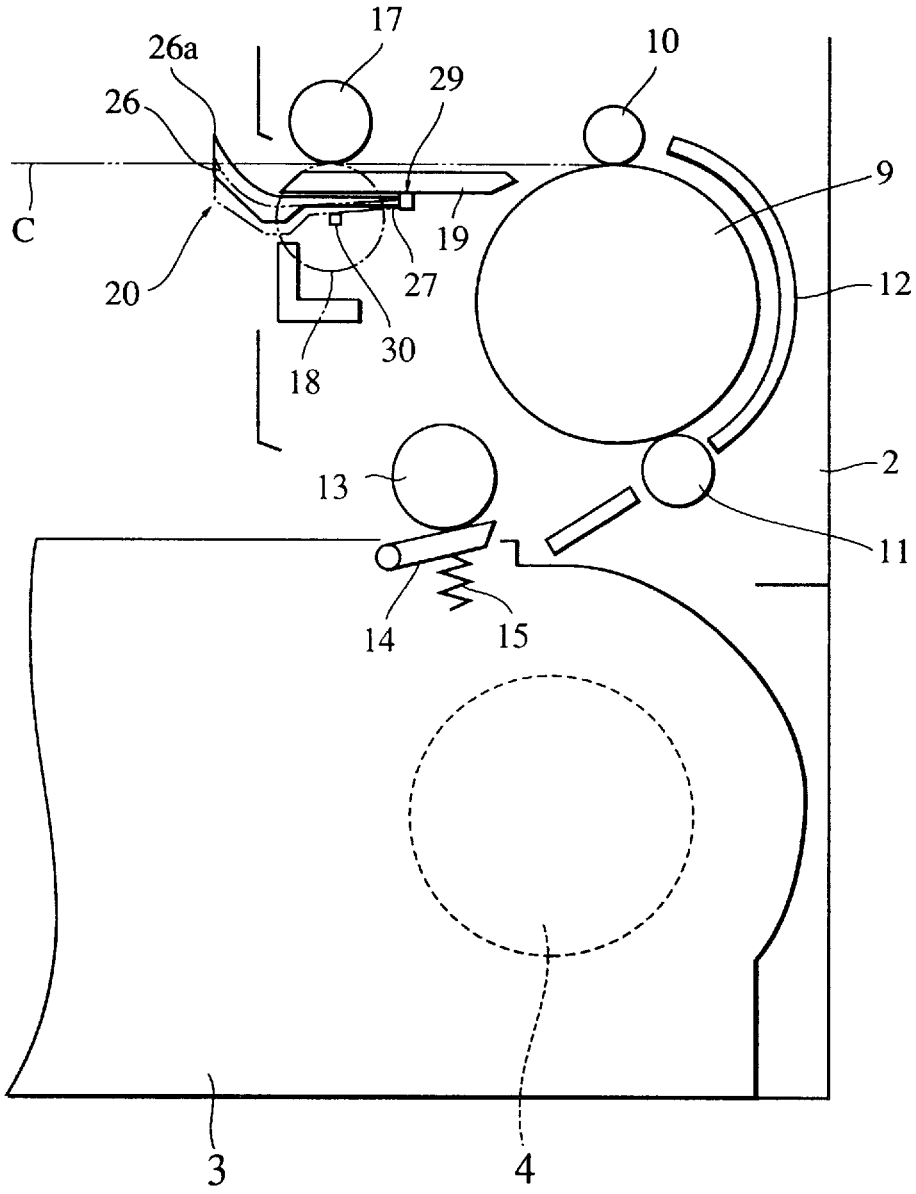
FIG. 11 is a schematic sectional view illustrating an apparatus in accordance with a sixth embodiment of the present invention.

FIG. 11 is a drawing illustrating an apparatus in accordance with a sixth embodiment of the present invention. In this embodiment, the elastic member is integrated with the delivery guide member, as in the embodiment shown in FIG. 8. Although the elastic member 27 first generates the urging force with a fixed end 29 as a fulcrum, an intermediate portion of the elastic member 27 contacts a contact portion 30 in the course of stroke, and then the urging force of the elastic member 27 stepwisely changes when the elastic member 27 is bent by the contact portion 30 in the subsequent stroke.

(Embodiment 7)

Figure 12:
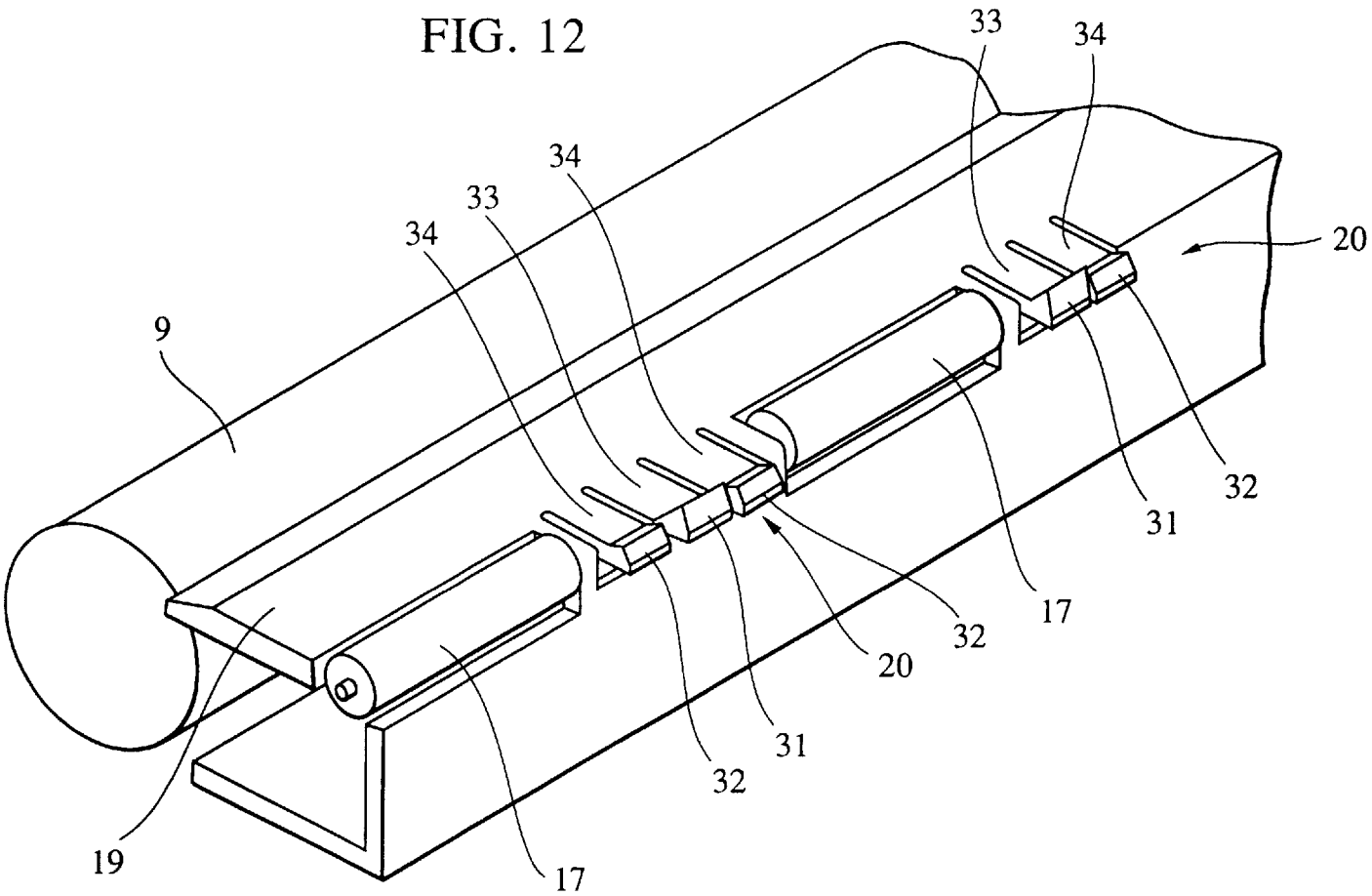
FIG. 12 is a schematic partial perspective view illustrating an apparatus in accordance with a seventh embodiment of the present invention.

FIG. 12 is a drawing illustrating an apparatus in accordance with a seventh embodiment of the present invention.

As illustrated in FIG. 12, although this embodiment is similar to the embodiment shown in FIG. 9, this embodiment is different therefrom in that the top heights of the guide portions 31 and 32 of the delivery guide member 20 are stepwisely changed. In this structure, conveyance of low-rigidity paper is restricted by the urging force of the high guide portion 31 and the elastic portion 33, and the conveyance of higher rigidity paper is restricted by the guide portions 31 and 32 and the elastic portions 33 and 34. The urging force thus stepwisely changes, and permits good recording.

(Embodiment 8)

Although the delivery guide member 20 comprises a single part, in this embodiment, the delivery guide portion itself is made deformable in a multi-step manner so that urging force can stepwisely be changed.

Figure 13:
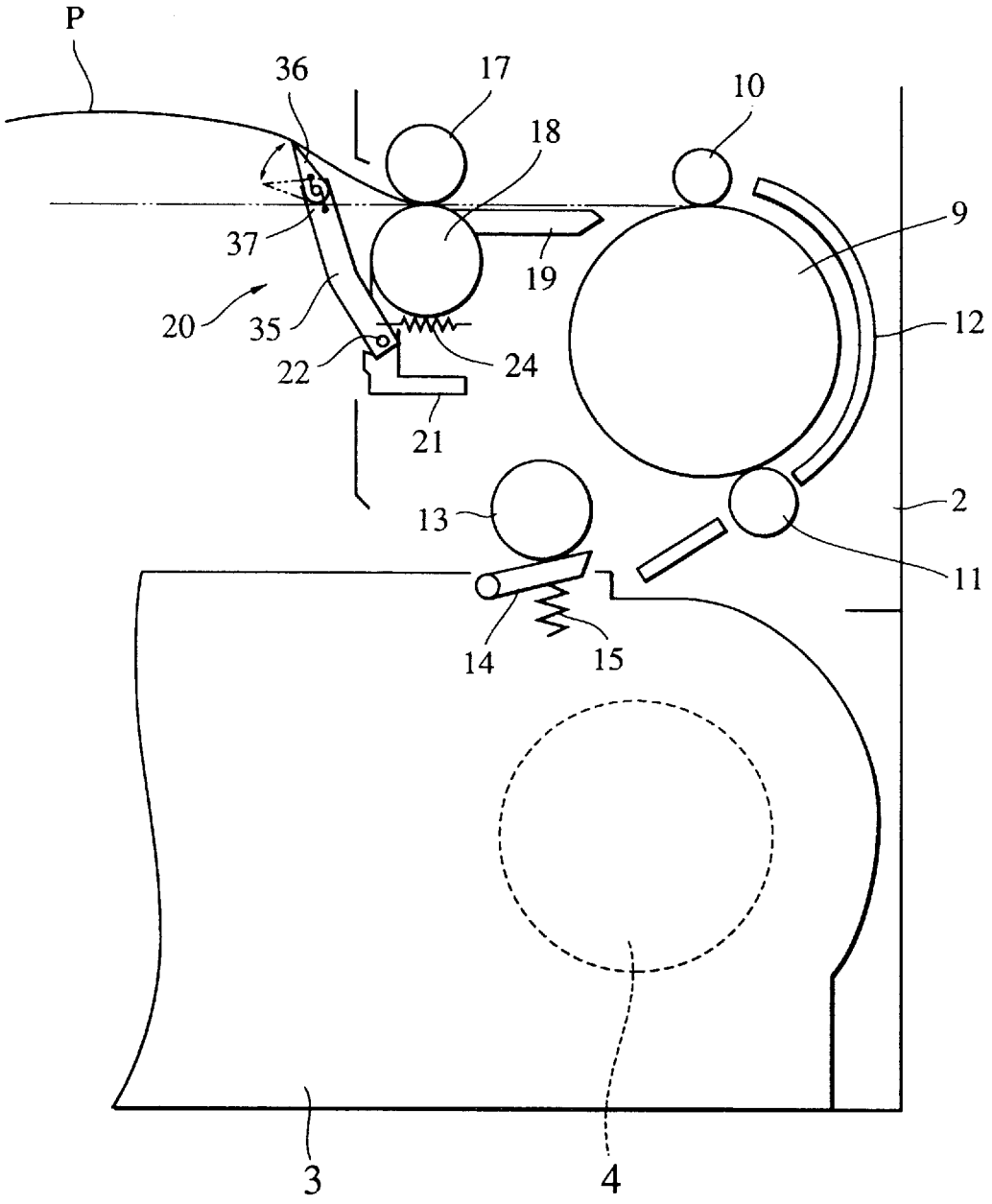
FIG. 13 is a schematic sectional view illustrating an apparatus in accordance with an eighth embodiment of the present invention.
Figure 14:
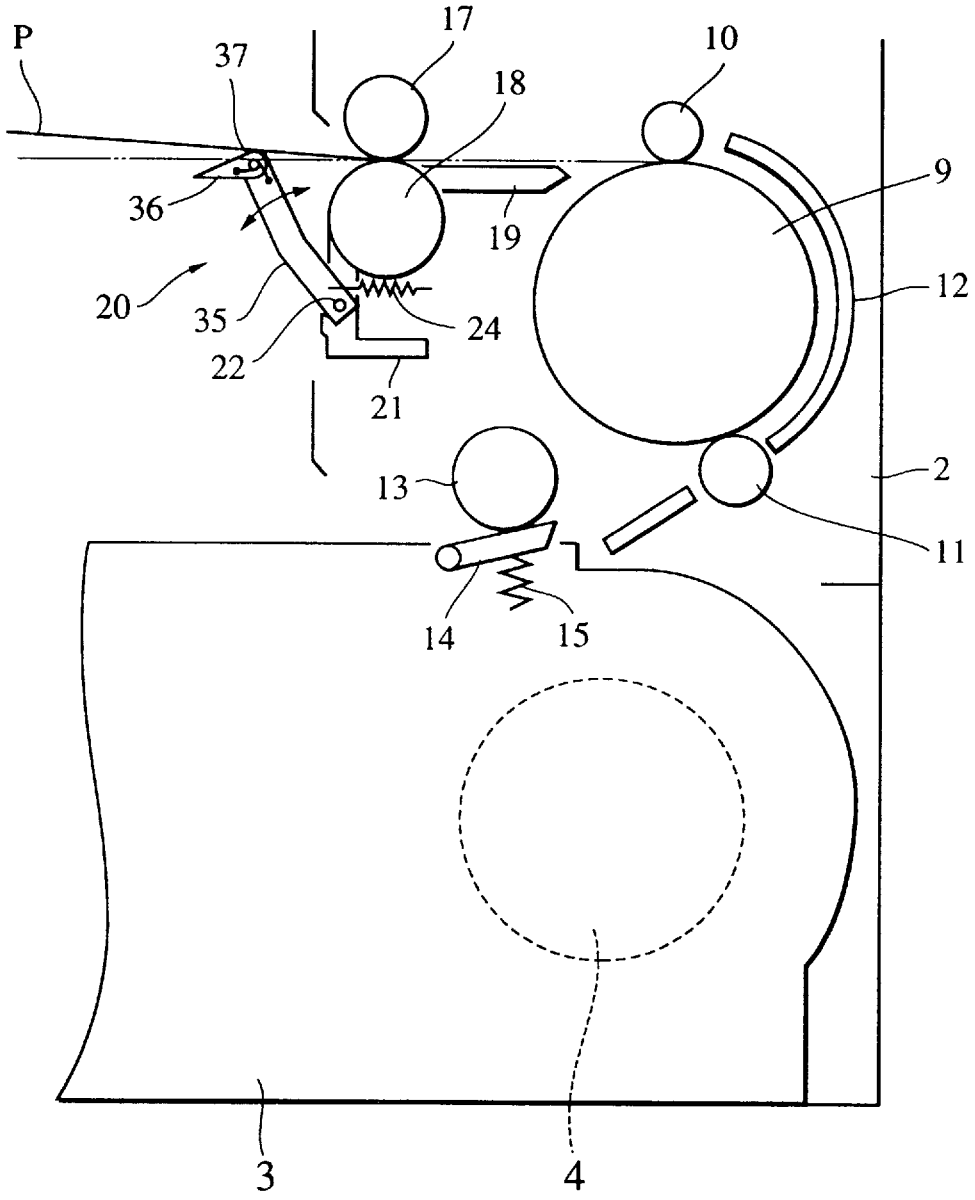
FIG. 14 is a schematic sectional view illustrating a state wherein a movable member provided on the upper portion of a delivery guide member is inclined due to a difference in the rigidity of paper in the apparatus shown in FIG. 13.

FIGS. 13 and 14 are drawings illustrating an apparatus in accordance with an eighth embodiment of the present invention. The movable member of the delivery guide member 20 is divided into a lower movable member 35 and an upper movable member 36 oscillatably fixed to the upper end of the lower movable member 35 by an elastic member 37 such as a coil spring or the like. The lower movable member 35 is rotatably fixed to a portion of a fixed member 21 by a hinge 22. To the lower movable member 35 is fixed one end of an urging member 24 with the other end fixed to the fixed member 21 so that the lower movable member 35 is urged in the direction nearer to the delivery roller 18.

As illustrated in FIG. 13, as for paper having relatively low rigidity, the top height of the delivery guide member 20 is adjusted by rotation of the upper movable member 36. As for paper having higher rigidity, the top height is adjusted by the lower movable member 35, as illustrated in FIG. 14. In this embodiment, the urging force of the elastic members 24 and 37 can be set so that the lower side is moved when paper has low rigidity, or the lower side is started to move in the course of the stroke of the upper side, thereby permitting setting with a higher degree of freedom.

(Embodiment 9)

In the above Embodiments 1 to 8, since paper is conveyed in contact with the top of the movable member, the frictional resistance between the paper and the top is possibly increased.

Figure 15:
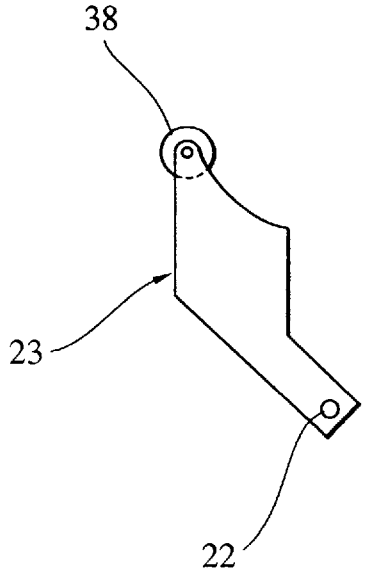
FIG. 15 is a schematic front view illustrating a principal portion of an apparatus in accordance with a ninth embodiment of the present invention.

In this embodiment, as shown in FIG. 15, a roller 38 is provided on the top of the movable member 23 so as to decrease as much as possible the frictional resistance of paper. The change in resistance caused by differences in paper quality can also be decreased, thereby permitting more stable recording.

(Embodiment 10)

Figure 16:
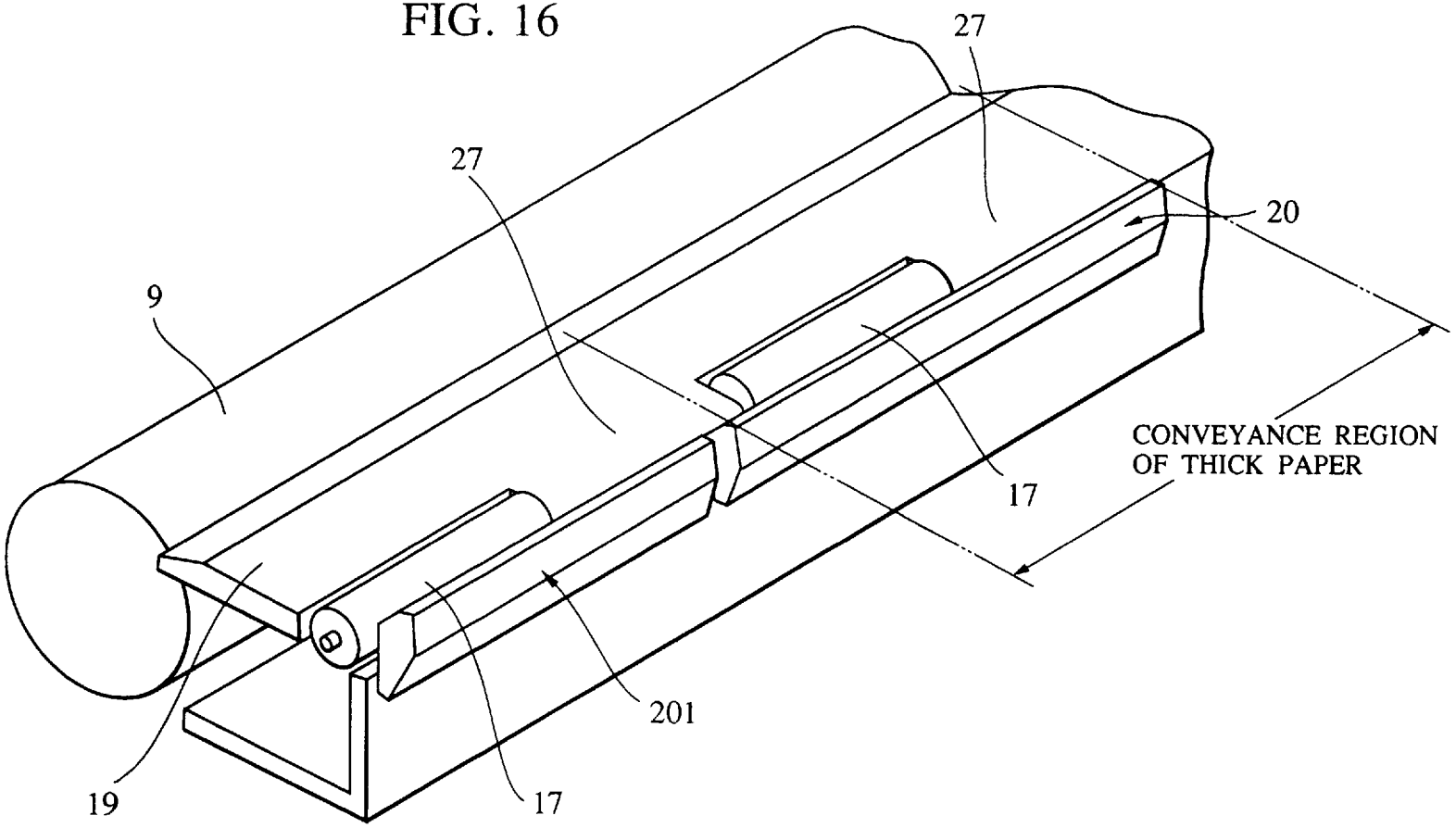
FIG. 16 is a schematic front view illustrating a principal portion of an apparatus in accordance with a tenth embodiment of the present invention.

In each of the above embodiments, the delivery guide member may be provided so as to contact the lower side of paper over the entire widthwise region thereof. Alternatively, if paper can sufficiently be deformed, the delivery guide member may be provided at only necessary positions without contact with the entire widthwise region of paper, as shown in FIGS. 9 and 12. When the conveyance of thick paper is limited to, for example, longitudinal conveyance of postcards, envelopes and so on, the movable delivery guide member 20 as described above is provided within only the conveyance region of thick paper, and the delivery guide member 201 provided within the other region through which only ordinary paper is passed is fixed at a height for conveyance of ordinary paper, as shown in Fig. 16. This structure also produces the same effects as those described above. There is sometimes a correlation between the size and thickness (rigidity) of paper to be delivered according to the purpose of use. In this case, the delivery guide member can be provided so that the force to urge the delivery guide member is changed in the lateral direction thereof in accordance with the paper size and thickness (rigidity), thereby permitting more stable conveyance.

(Other Embodiments)

Each of the above embodiments is provided with means (for example, electrothermal converter, laser beam or the like) for generating thermal energy as energy employed for discharging ink in the ink jet recording system, and has excellent effects on a recording head and recording apparatus of the type in which the state of the ink is changed by the thermal energy. This is because such a system can achieve increases in recording density and fineness.

It is preferred to use as the typical structure and principle the basic principle disclosed in, for example, U.S. Pat. Nos. 4,723,129 and 4,740,796. This system can be applied to both the so-called on-demand type and continuous type. Particularly, in the case of the on-demand type, thermal energy is generated in the electrothermal converter disposed corresponding to a sheet or liquid passage holding a liquid (ink) by applying thereto at least one driving signal for providing the electrothermal converter with a rapid temperature rise beyond nuclear boiling corresponding to record information to produce film boiling in the thermal working surface of the recording head. As a result, bubbles can effectively be formed in the liquid (ink) in one-to-one correspondence with the driving signal. The liquid (ink) is discharged through a discharge opening by growth and shrinkage of bubbles to form at least one droplet. Since the pulse-form driving signal appropriately causes instantaneous growth and shrinkage of bubbles, and particularly, the signal can achieve discharge of the liquid (ink) with excellent responsibility, the pulse-form driving signal is more preferred. The driving signals disclosed in U.S. Pat. Nos. 4,463,359 and 4,345,262 are preferred as the pulse-form driving signal. If the conditions disclosed in U.S. Pat. No. 4,313,124 of the invention relating to a rate of temperature rise of the thermal working surface are used, more excellent recording can be performed.

The structure of the recording head of the present invention includes the structure comprising combination of the discharge opening, the liquid passage (linear liquid passage or right-angle liquid passage) and the electrothermal converter, as disclosed in the above specifications, and the structure disclosed in U.S. Pat. Nos. 4,558,333 and 4,459,600 in which the thermal working portion is disposed in a bend region. The present invention is also effective for a structure based on Japanese Patent Laid-Open No. 59-123670 disclosing a structure in which a slit common to a plurality of electrothermal converters is provided as a discharge portion of the electrothermal converters, and a structure based on Japanese Patent Laid-Open No. 59-138461 disclosing a structure in which an opening for absorbing the pressure wave of thermal energy is provided in correspondence with a discharge portion. Namely, any one of the forms of the recording heads permits the present invention to securely and efficiently perform recording.

The present invention can also effectively be applied to a full-line type recording head having a length corresponding to the maximum width of a recording medium on which a recording apparatus can record. Such a recording head may comprise combination of a plurality of recording heads which satisfy the length thereof, or may be formed as an integrally formed recording head.

The present invention is also effective for the case in which a recording head fixed to the apparatus body, an exchangeable chip type recording head which is mounted on the apparatus body to permit electrical connection with the apparatus body and supply of ink therefrom, or a cartridge type recording head having an ink tank integrally provided thereon is used as the above serial type recording head.

It is also preferred for obtaining more stable effects of the present invention to add, as components, means for recovering the discharge of the recording head, preliminary auxiliary means etc. to the recording apparatus in accordance with each of the above embodiments. Examples of such means include means for capping the recording head, cleaning means, pressure or suction means, preliminary heating means for heating by using an electrothermal convert, another heating element or combination thereof, and preliminary discharge means for discharging ink for another purpose.

In regard to the type and number of the recording heads mounted on the apparatus, only one recording head may be provided for a single color ink, or a plurality of recording heads may be provided in correspondence with a plurality of inks having different record colors and densities. Namely, the present invention is very effective for a recording apparatus having not only a recording mode for a main color such as black or the like, but also at least one full-color recording mode for a plurality of different colors or color mixture. In this case, the recording head may be integrally formed or formed by combining a plurality of heads.

Further, although each of the above embodiments uses a liquid ink, an ink which is solidified at room temperature or less and softened or liquefied at room temperature may be used. In the ink jet system, since the temperature of ink is generally controlled within the range of 30° C. to 70° C. so that the viscosity of the ink is within the range of sable discharge, an ink which is liquid at the time of application of the recording signal used may be used. In addition, an ink which is solidified by allowing it to stand and liquefied by heating may be used for preventing the the temperature rise caused by thermal energy, by using the temperature rise as the energy for the change of state from the solid state to the liquid state of the ink, or preventing evaporation of the ink. In any case, the present invention can be applied to a case using ink which is not liquefied until thermal energy is applied thereto, such as ink which is liquefied by application of thermal energy corresponding to a recording signal to be discharged as liquid ink, or ink which has already been started to solidify when reaching the recording medium. Such ink may be opposed to the electrothermal converter in the state where it is held as a liquid or solid in recessed portions or through holes of a porous sheet, as disclosed in Japanese Patent Publication No. 54-56847 and Japanese Patent Laid-Open No. 60-71260. When the film boiling process is performed, the present invention is most effective for each of the inks.

In addition, the ink jet recording apparatus in accordance with the present invention may be an apparatus used as an image output terminal of an information processing apparatus such as a computer, a copying apparatus combined with a reader, or a facsimile apparatus having the transmitting and receiving function.

As described above, in each of the embodiments, since the delivery guide member is provided near the delivery roller on the downstream side thereof so as to project from the conveyance plane between the conveyance roller and the delivery roller to the side opposite to the platen, it is possible to prevent floating and rising of the trailing end, permit stable conveyance and decrease the margin at the trailing end even if the delivery roller alone is provided as the roller for conveying paper.

The present invention does also not need to be provided with a delivered paper tray, and is thus suitable for miniaturization of the apparatus.

Further, since the delivery guide member is restricted to the normal position by the elastic force, the delivery guide member forms a conveyance passage for paper having relatively low rigidity, such as ordinary paper or the like, so as to upwardly push the paper toward the side opposite to the platen, and the delivery guide member is moved to a substantially horizontal position relative to the conveyance plane for high-rigidity paper such as thick paper, postcards or the like, so as not to force to upwardly push the paper to the side opposite to the platen. Since the conveyance resistance caused by the rigidity of paper is thus decreased, a good printing state can be maintained for various types of paper.

What is claimed is:

1. An information processing apparatus having an information processing section with a head member for recording information on a sheet member or reading information therefrom, comprising:

a platen disposed in said information processing section;

a supporting member disposed opposite to said platen in said information processing section so as to support the head member for recording information on the sheet member or reading information therefrom;

a conveyance mechanism for conveying the sheet member in a conveyance passage through said information processing section; and a conveyance passage displacement mechanism comprising a force member which displaces an end of said sheet member to the side of said platen by bending said sheet member discharged from the area where said platen and said supporting member are opposed into the side of said supporting member, said conveyance displacement mechanism further comprising means for deciding the displacement amount of the sheet member in a conveyance direction in accordance with the rigidity of said sheet member which is opposite to the force of said forcing member.

2. An information processing apparatus according to claim 1, further comprising an elastic member for urging said conveyance passage displacement mechanism to the supporting member side of the conveyance passage for the sheet member from the platen side thereof.

3. An information processing apparatus according to claim 1, wherein said conveyance passage displacement mechanism further comprises a member containing an elastic material.

4. An information processing apparatus according to claim 1, wherein said conveyance passage displacement mechanism is formed integrally with said platen.

5. An information processing apparatus according to claim 1, wherein the head member comprises an ink jet recording head which discharges ink from an ink discharge opening to record on the sheet member.

6. An information processing apparatus according to claim 1, wherein the head member comprises an ink jet recording head provided with an electrothermal converter for generating thermal energy utilized for discharging ink.

7. An information processing apparatus according to claim 1, wherein the head member comprises a read head for reading information possessed by the sheet member.

8. An information processing apparatus according to claim 1, wherein said conveyance passage displacement mechanism is rotatably attached to said apparatus.

9. An information processing apparatus according to claim 1, wherein said conveyance passage displacement mechanism is attached by a slidable connection to said apparatus.

10. An information processing apparatus according to claim 1, wherein said conveyance passage displacement mechanism comprises a coil spring.

11. An information processing apparatus according to claim 1, wherein said conveyance passage displacement mechanism further comprises a plate spring.

12. An information processing apparatus according to claim 1, wherein said conveyance passage displacement mechanism further comprises a plurality of spring members.

13. An information processing apparatus according to claim 1, wherein said conveyance passage displacement mechanism further comprises means for extending the length of said conveyance passage displacement mechanism.

14. An information processing apparatus using a head member for recording information on a sheet member or reading information therefrom, said apparatus comprising:

a platen;

a supporting member disposed opposite to said platen so as to support the head member for recording information on the sheet member or reading information therefrom;

a conveyance mechanism for conveying the sheet member in a conveyance passage through a space between said platen and said supporting member; and a conveyance passage displacement mechanism displacing the end of said sheet member to a side of said platen by bending said sheet member discharged from an area where said platen and said supporting member are opposed into a side of said supporting member, said conveyance passage displacement mechanism comprising means for deciding the displacement amount of the sheet member in a passage direction in accordance with the rigidity of said sheet member.

15. An apparatus according to claim 14, wherein said conveyance passage displacement mechanism changes the amount of displacement in accordance with a stiffness of the sheet member.

16. An apparatus according to claim 14, wherein said conveyance passage displacement mechanism decreases the amount of displacement in accordance with increase of stiffness of the sheet member.

17. An information processing apparatus according to claim 14, further comprising an elastic member for urging said conveyance passage displacement mechanism to the supporting member side of the conveyance passage for the sheet member from the platen side thereof.

18. An information processing apparatus according to claim 14, wherein said conveyance passage displacement mechanism further comprises a member containing an elastic material.

19. An information processing apparatus according to claim 14, wherein said conveyance passage displacement mechanism is formed integrally with said platen.

20. An information processing apparatus according to claim 14, wherein the head member comprises an ink jet recording head which discharges ink from an ink discharge opening to record on the sheet member.

21. An information processing apparatus according to claim 14, wherein the head member comprises an ink jet recording head provided with an electrothermal converter for generating thermal energy utilized for discharging ink.

22. An information processing apparatus according to claim 14, wherein the head member comprises a read head for reading information possessed by the sheet member.

23. An information processing apparatus according to claim 14, wherein said conveyance passage displacement mechanism is rotatably attached to said apparatus.

24. An information processing apparatus according to claim 14, wherein said conveyance passage displacement mechanism is attached by a slidable connection to said apparatus.

25. An information processing apparatus according to claim 14, wherein said conveyance passage displacement mechanism comprises a coil spring.

26. An information processing apparatus according to claim 14, wherein said conveyance passage displacement mechanism comprises a plate spring.

27. An information processing apparatus according to claim 14, wherein said conveyance passage displacement mechanism comprises a plurality of spring members.

28. An information processing apparatus according to claim 14, wherein said conveyance passage displacement mechanism further comprises means for extending the length of said conveyance passage displacement mechanism.

* * * * *

UNITED STATES PATENT AND TRADEMARK OFFICE

CERTIFICATE OF CORRECTION

PATENT NO. : 5,820,282

DATED : October 13, 1998

INVENTOR : HIROSHI NAKAI

It is certified that error appears in the above-identified patent and that said Letters Patent is hereby corrected as shown below:

COLUMN 3,
Line 8, "provided" should read --provide--.

COLUMN 7,
Line 40, "stepwisely" should read --stepwise--;
Line 52, "stepwisely changes" should read --changes stepwise.--; and
Line 65, "stepwisely changes" should read --changes stepwise--.

COLUMN 8,
Line 8, "stepwisely" should read --stepwise--;
Line 13, "stepwisely changes," should read --changes stepwise,--; and
Line 19, "stepwisely be changed." should read --be changed stepwise.--.

UNITED STATES PATENT AND TRADEMARK OFFICE

CERTIFICATE OF CORRECTION

PATENT NO. : 5,820,282

DATED : October 13, 1998

INVENTOR : HIROSHI NAKAI

It is certified that error appears in the above-identified patent and that said Letters Patent is hereby corrected as shown below:

COLUMN 10,
Line 35, "sable" should read --stable--; and
Line 47, "been" should be deleted.

Signed and Sealed this

Thirteenth Day of July, 1999

*Attest:*

*Attesting Officer*

Q. TODD DICKINSON

*Acting Commissioner of Patents and Trademarks*